US008253007B1

(12) United States Patent
Steinberger

(10) Patent No.: US 8,253,007 B1
(45) Date of Patent: Aug. 28, 2012

(54) POTENTIOMETER CONTROL FOR MUSICAL INSTRUMENTS

(76) Inventor: Richard Ned Steinberger, Nobleboro, ME (US)

( * ) Notice: Subject to any disclaimer, the term of this patent is extended or adjusted under 35 U.S.C. 154(b) by 102 days.

(21) Appl. No.: 12/927,422

(22) Filed: Nov. 15, 2010

Related U.S. Application Data

(60) Provisional application No. 61/281,490, filed on Nov. 18, 2009.

(51) Int. Cl.
*G10H 1/00* (2006.01)

(52) U.S. Cl. ..... 84/725; 84/723; 84/726; 338/215; 338/68

(58) Field of Classification Search ..... 84/723, 84/725–728
See application file for complete search history.

(56) References Cited

U.S. PATENT DOCUMENTS

| | | | | | |
|---|---|---|---|---|---|
| 2,499,711 | A * | 3/1950 | Wolff et al. | 338/198 |
| 2,812,400 | A * | 11/1957 | Budd | 200/434 |
| 2,812,407 | A * | 11/1957 | Budd | 338/171 |
| 2,855,490 | A * | 10/1958 | Arisman et al. | 338/172 |
| 2,887,553 | A * | 5/1959 | Glueckstein et al. | 338/171 |
| 2,909,749 | A * | 10/1959 | Barden et al. | 338/163 |
| 2,929,040 | A * | 3/1960 | Barden et al. | 338/172 |
| 2,942,221 | A * | 6/1960 | Di Girolamo | 338/200 |
| 3,039,346 | A * | 6/1962 | Martin | 84/718 |
| 3,161,847 | A * | 12/1964 | Matsunaga | 338/172 |
| 3,205,466 | A * | 9/1965 | Youngbeck et al. | 338/163 |
| 3,213,181 | A * | 10/1965 | Snoddy et al. | 84/726 |
| 3,375,446 | A * | 3/1968 | Guyton | 455/220 |
| 3,626,078 | A * | 12/1971 | Sekiguchi | 84/737 |
| 3,657,936 | A * | 4/1972 | Judd | 74/128 |
| 3,845,447 | A * | 10/1974 | Ashiya et al. | 338/200 |
| 3,896,697 | A * | 7/1975 | Iannone | 84/454 |
| 4,050,050 | A * | 9/1977 | Nakanishi et al. | 338/190 |
| 4,081,782 | A * | 3/1978 | Hildreth et al. | 338/200 |
| 4,090,167 | A * | 5/1978 | Walker et al. | 338/172 |
| 4,110,721 | A * | 8/1978 | Nakanishi et al. | 338/128 |
| 4,117,444 | A * | 9/1978 | Hildreth et al. | 338/198 |
| 4,123,740 | A * | 10/1978 | Palmer et al. | 338/67 |
| 4,329,676 | A * | 5/1982 | McDonald et al. | 338/198 |
| 4,371,780 | A * | 2/1983 | Gossler et al. | 219/457.1 |
| 4,545,278 | A * | 10/1985 | Gagon et al. | 84/726 |
| 4,569,077 | A * | 2/1986 | Marinelli | 381/113 |
| 4,682,142 | A * | 7/1987 | Lohner et al. | 338/172 |
| 4,827,241 | A * | 5/1989 | Riser et al. | 338/172 |
| 4,903,003 | A * | 2/1990 | Kuratani et al. | 338/198 |
| 5,140,111 | A * | 8/1992 | Vultaggio et al. | 200/4 |
| 6,121,537 | A * | 9/2000 | Pawar et al. | 84/728 |
| 7,163,192 | B2 * | 1/2007 | Aoki et al. | 251/248 |
| 7,208,673 | B2 * | 4/2007 | Bryce | 84/742 |
| 7,999,171 | B1 * | 8/2011 | Hamilton | 84/727 |
| 2002/0073830 | A1 * | 6/2002 | Petherick | 84/726 |
| 2002/0161548 | A1 * | 10/2002 | Elliott et al. | 702/151 |
| 2004/0168539 | A1 * | 9/2004 | Rosencrantz | 74/543 |
| 2004/0168606 | A1 * | 9/2004 | Rosencrantz et al. | 105/396 |
| 2005/0116809 | A1 * | 6/2005 | Cochran | 338/176 |
| 2010/0282046 | A1 * | 11/2010 | Crocker | 84/633 |

* cited by examiner

*Primary Examiner* — David S. Warren
(74) *Attorney, Agent, or Firm* — Saul Epstein

(57) ABSTRACT

A potentiometer control for use as a volume or tone control for a musical instrument, such as a guitar, that includes a switch which switches out the resistive element when the control is set to its most clockwise position so as to not load the instrument pickup when desired and so permit maximum volume to be achieved.

7 Claims, 3 Drawing Sheets

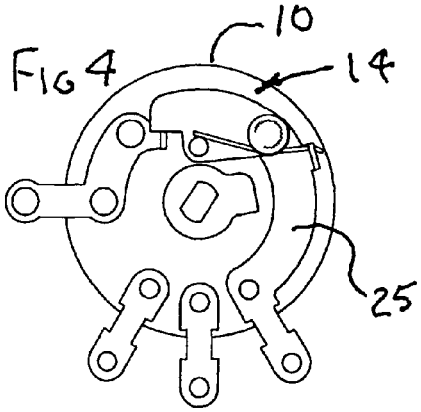
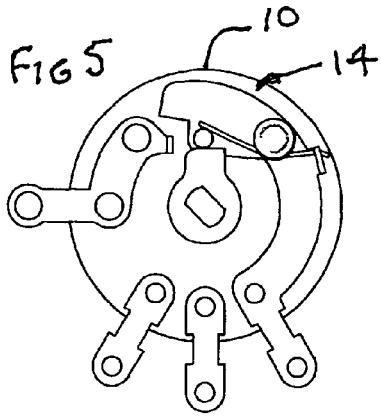
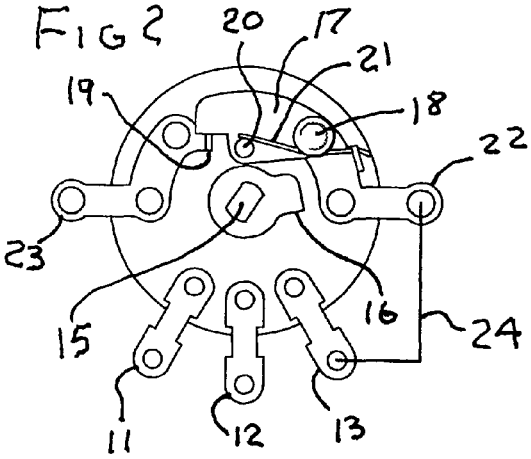
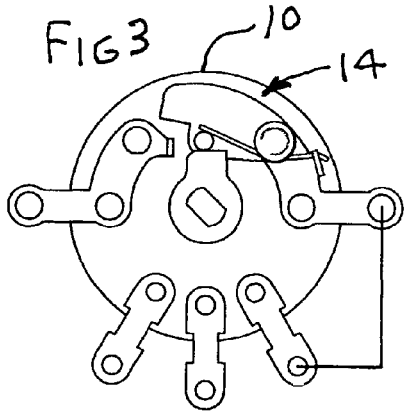
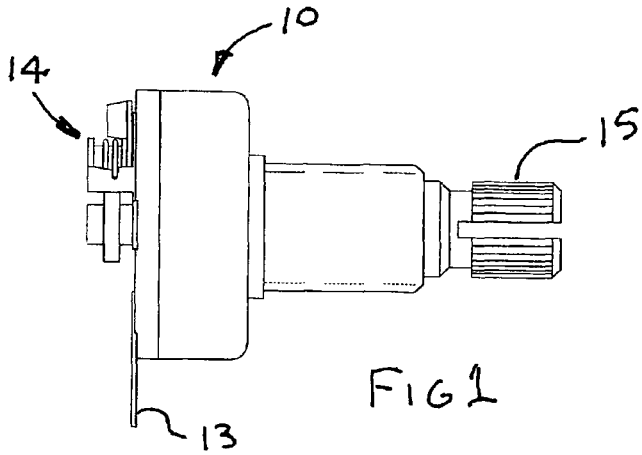
FIG 1

POTENTIOMETER CONTROL FOR MUSICAL INSTRUMENTS

RELATED APPLICATIONS

This application claims the benefit under 35 USC §119(e) of the filing date of U.S. Provisional Patent Application No. 61/281,490 entitled "Load-Free Control Circuit Design for Electric String Instruments" filed Nov. 18, 2009.

BACKGROUND OF THE INVENTION

Stringed musical instruments that contain electrical pickups commonly also include a volume and possibly a tone control. Such self-contained controls allow the performer him or her self to alter the level and quality of the performance while it is taking place. The controls usually take the form of a potentiometer connected between the pickup and the amplifier input. In the case of a tone control, a capacitor is usually also included. One problem that exists is that the pickups, be they magnetic or piezo crystal, have a relatively high impedance, and the control potentiometers present a significant load to the pickup, limiting the maximum volume and frequency response attainable. It is possible to switch a potentiometer out of the circuit when more volume and full frequency response is desired, but auxiliary switches are not convenient, and ordinary switches are generally of the "snap action" type and so create an undesired sound in the amplified signal (partly because of mechanical coupling).

SUMMARY OF THE INVENTION

The present invention involves the use of a standard potentiometer modified to include a cam operated switch. In the description and claims that follow, potentiometer position will always be referred to from the point of view of a user, i.e., as viewing the potentiometer from the control knob side. The switch is connected to the counter-clockwise end of the potentiometer resistance element and is normally closed. That is, the switch opens when the potentiometer is turned to its most clockwise setting but is closed when the potentiometer is at any other position.

When used as a volume control, the clockwise end of the resistance element is preferably connected to the amplifier "hot" input terminal, and the free terminal of the switch is connected to amplifier ground. The electrical pickup on the instrument (which can be either a piezo crystal or inductive pickup) is preferably connected between the potentiometer wiper and ground.

As a tone control, ordinarily, the potentiometer is connected as a rheostat (including the switch), with a capacitor in series across the amplifier input. Turning the control to maximum clockwise causes the switch to open and any residual load to be removed from the circuit.

BRIEF DESCRIPTION OF THE DRAWINGS

FIG. 1 is a side view of a first embodiment of the invention.

FIG. 2 is a rear view of the first embodiment of the invention with the control set somewhat counter-clockwise from the clockwise end of travel.

FIG. 3 is a rear view of the first embodiment of the invention with the control set in its fully clockwise position.

FIG. 4 is a rear view of a second embodiment of the invention with the control set somewhat counter-clockwise from the clockwise end of travel.

FIG. 5 is a rear view of the second embodiment of the invention with the control set in its fully clockwise position.

DETAILED DESCRIPTION OF THE INVENTION

Figure 6:
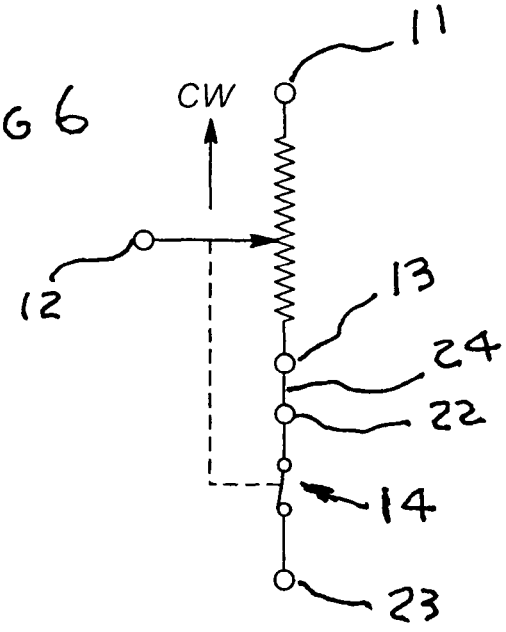
FIG. 6 is a schematic diagram of the first embodiment of the invented control.

FIG. 1 depicts a side view of one embodiment of the invention, comprised of a conventional potentiometer 10 having three terminals 11-13 mounted on its rear surface, and a cam-operated switch 14 (also mounted on the potentiometer rear surface). In use, there would commonly be a knob installed on the shaft 15 for user control, but a knob is not a part of this invention, and is not illustrated. The potentiometer, being a conventional and well-known component, is not described in detail. If the invention is to be used as a volume control on an instrument having a piezo crystal pickup, the potentiometer would typically have a resistance of about one megohm, or if the pickup is of the magnetic type, the resistance may be lower. Different designers might prefer to use different values of resistance, depending on the associated circuitry. The potentiometer might have a "linear taper", an "audio taper", or other position/resistance characteristic as desired for different applications.

The switch 14 is actuated by a cam 16 that is attached to shaft 15 where it exits the rear of potentiometer 10. The switch 14 itself is comprised of a switch arm 17 that rotates about pin 18 and contacts contact point 19 when shaft 15 is not in its full clockwise position (as shown in FIG. 2). When shaft 15 is in its full clockwise position (FIG. 3) cam 16 contacts pin 20, lifting switch arm 17 away from contact point 19. Cam 16 is shaped such that the switch arm 17 moves smoothly away from the contact 19 thereby avoiding the mechanical noise associated with commonly used switches. Spring 21 pushes against pin 20 to maintain the switch 14 closed when the shaft is away from the full clockwise position. Electrically, the switch 14 is terminated at terminals 22 and 23. Terminals 13 and 22 are connected by jumper 24. In the embodiment of FIGS. 4 and 5, instead of jumper 24, a permanent strap 25 connects the switch to terminal 13, and terminal 22 is omitted.

FIG. 6 shows an electrical schematic of the embodiment shown in FIGS. 2 and 3. The schematic of the embodiment of FIGS. 4 and 5 would be the same, except that strap 25 connects the switch to terminal 13 of the potentiometer, eliminating the need for a jumper (24) between the switch and the potentiometer.

Figure 7:
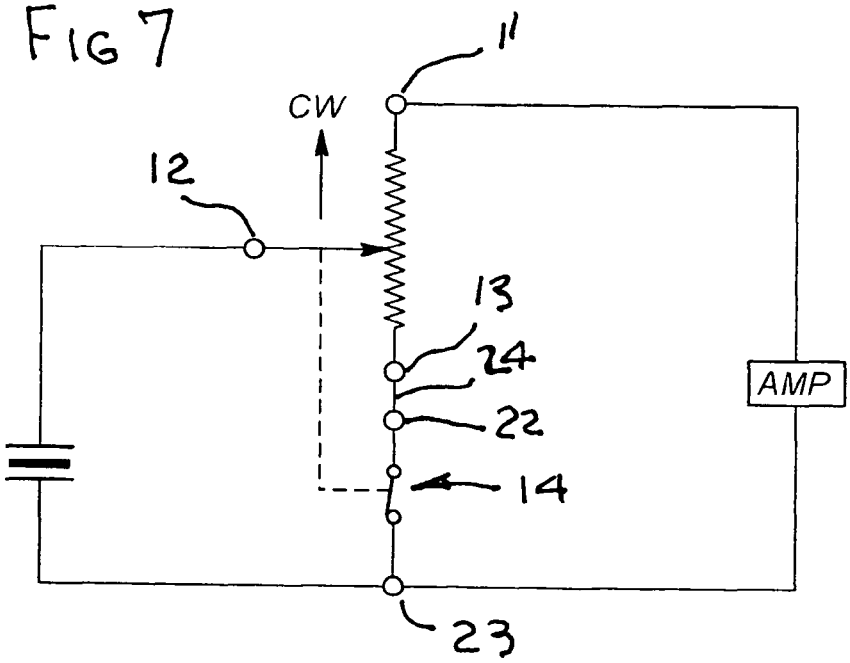
FIGS. 7-9 are schematic diagrams of representative circuits showing how the invented control can be wired for use with stringed musical instruments.
Figure 8:
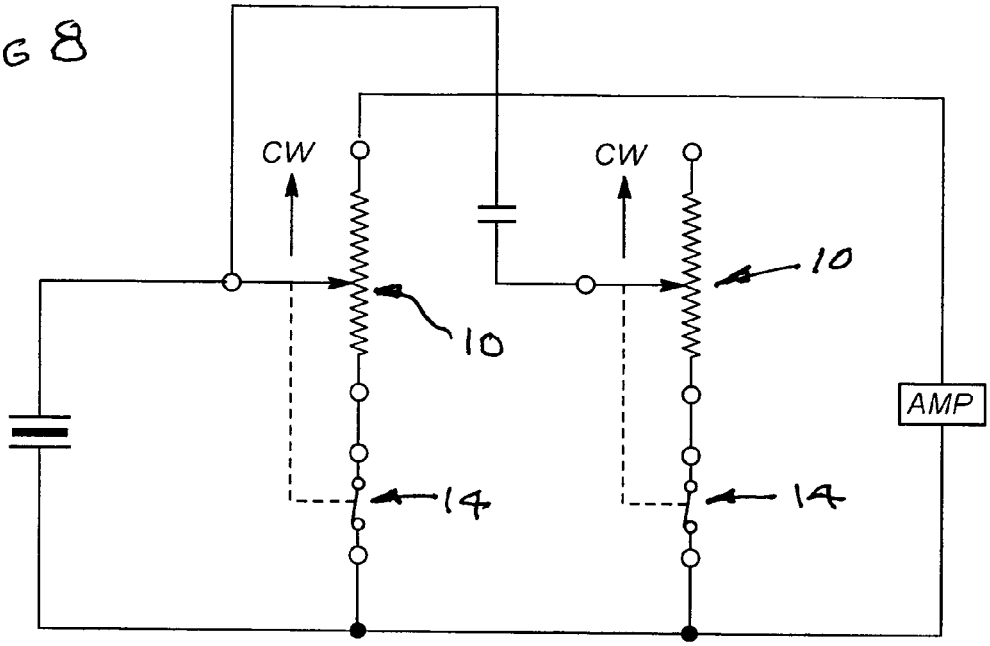
Figure 9:
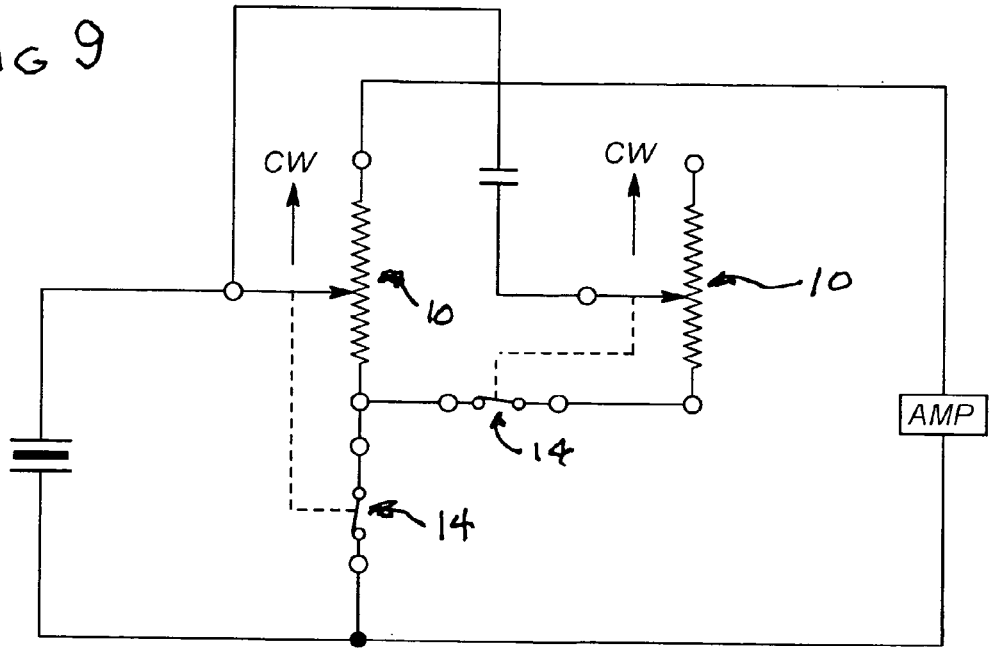

FIGS. 7-9 show several typical schematics depicting ways of connecting the invented control in musical instrument systems. The schematics shown depict only a few of the ways that the invented control may be used. Persons having ordinary skill in the art will be aware of other possible ways of wiring the invented controls to accomplish their desired results. The invented control will probably be most useful when mounted on the instrument itself, but it could be mounted on the amplifier, or on an auxiliary control box if desired. For convenience, the symbol used to represent the pickup in FIGS. 7-9 is that commonly used to represent piezo crystal pickups, but other pickups such as magnetic pickups can be used as well. FIG. 7 shows the preferred way that the control can be wired as to act as a volume control, whereas FIGS. 8 and 9 show using two of the invented controls so as to provide both volume and tone control functions.

I claim:

1. A control for a musical instrument, said musical instrument having an electric pickup providing an electrical signal corresponding to notes played comprising:

a potentiometer including a clockwise terminal, a counter-clockwise terminal, a wiper terminal and a shaft;

a cam attached to one end of said shaft; and a switch responsive to said cam attached to said potentiometer, said switch including a switch arm and a contact, said cam holding said switch arm away from said contact when said shaft is at its full clockwise position but allowing said switch arm to contact said contact at all other positions of said shaft wherein said clockwise terminal is connected to the input of an amplifier; and a terminal of said electronic pickup is connected one of said contact or said switch arm.

2. A control for a musical instrument as recited in claim 1 and further including a jumper connecting said switch to said counter-clockwise terminal.

3. A control for a musical instrument as recited in claim 1 and further including a pivot at one end of said switch arm.

4. A control for a musical instrument as recited in claim 3 and further including a spring that urges said switch arm toward said contact.

5. A control for a musical instrument as recited in claim 1 where said electric pickup has two terminals and:

said switch arm is connected to said counter-clockwise terminal;

said wiper terminal is connected to a first terminal of said electric pickup.

6. A control for a musical instrument, said musical instrument having an electric pickup providing an electrical signal corresponding to notes played comprising:

a potentiometer including a clockwise terminal, a counter-clockwise terminal, a wiper terminal and a shaft;

a cam attached to one end of said shaft; and a switch responsive to said cam attached to said potentiometer, said switch including a switch arm and a contact, said cam holding said switch arm away from said contact when said shaft is at its full clockwise position but allowing said switch arm to contact said contact at all other positions of said shaft, said switch further including two connecting points, wherein said counter-clockwise terminal is connected to one of said switch connecting points providing a load-free control circuit for said musical instrument.

7. A control for a musical instrument as recited in claim 6 and further including a jumper connecting said switch to said counter-clockwise terminal, wherein said counter-clockwise terminal is connected to one of said switch connecting points by means of a jumper.

* * * * *